United States Patent [19]

Shrock

[11] 4,321,716

[45] Mar. 30, 1982

[54] CONVERTIBLE SEAT-BED

[76] Inventor: Fred J. Shrock, 28884 Kehres, Elkhart, Ind. 46514

[21] Appl. No.: 67,361

[22] Filed: Aug. 17, 1979

[51] Int. Cl.[3] ..... A47C 17/17

[52] U.S. Cl. ..... 5/18 R; 5/37 R; 5/47

[58] Field of Search ..... 5/17, 18 R, 18 B, 37 R, 5/44 R–46, 47; 297/63, 65, 67, 83, 87

[56] References Cited

U.S. PATENT DOCUMENTS 2,050,658 8/1936 Holt ..... 5/44 R
3,913,152 10/1975 Quakenbush ..... 5/18 R
4,001,901 1/1977 Quakenbush ..... 5/18 R
4,131,960 1/1979 Quakenbush ..... 5/37 R

*Primary Examiner*—Casmir A. Nunberg
*Attorney, Agent, or Firm*—Eugene G. Botz

[57] ABSTRACT

This invention relates to convertible seat-bed assemblies. More particularly it relates to such seat-bed assemblies having linkage means supporting the seat and back supports from a base structure for movement between a seating position and a bed position. Because of the use of simple linkage only, this invention is more economical to manufacture and lighter in weight than the prior art convertible seat-beds.

9 Claims, 5 Drawing Figures

CONVERTIBLE SEAT-BED

SUMMARY OF THE INVENTION

The purpose of the invention is to improve upon the prior art by making a convertible seat-bed which has less weight and is more economical to manufacture.

A more specific object of the invention is to provide a construction wherein only simple linkage is used and incorporates important advantages including the coordinate movement of the seat and back such that the adjacent portions of the seat and back cushions in the seat and bed positions maintain a predetermined distance from each other. Also, because of the linkage used the top edge of the back cushion moves in an almost vertical path requiring very little clearance space away from an adjacent wall when moving from one position to another.

Figure 1:
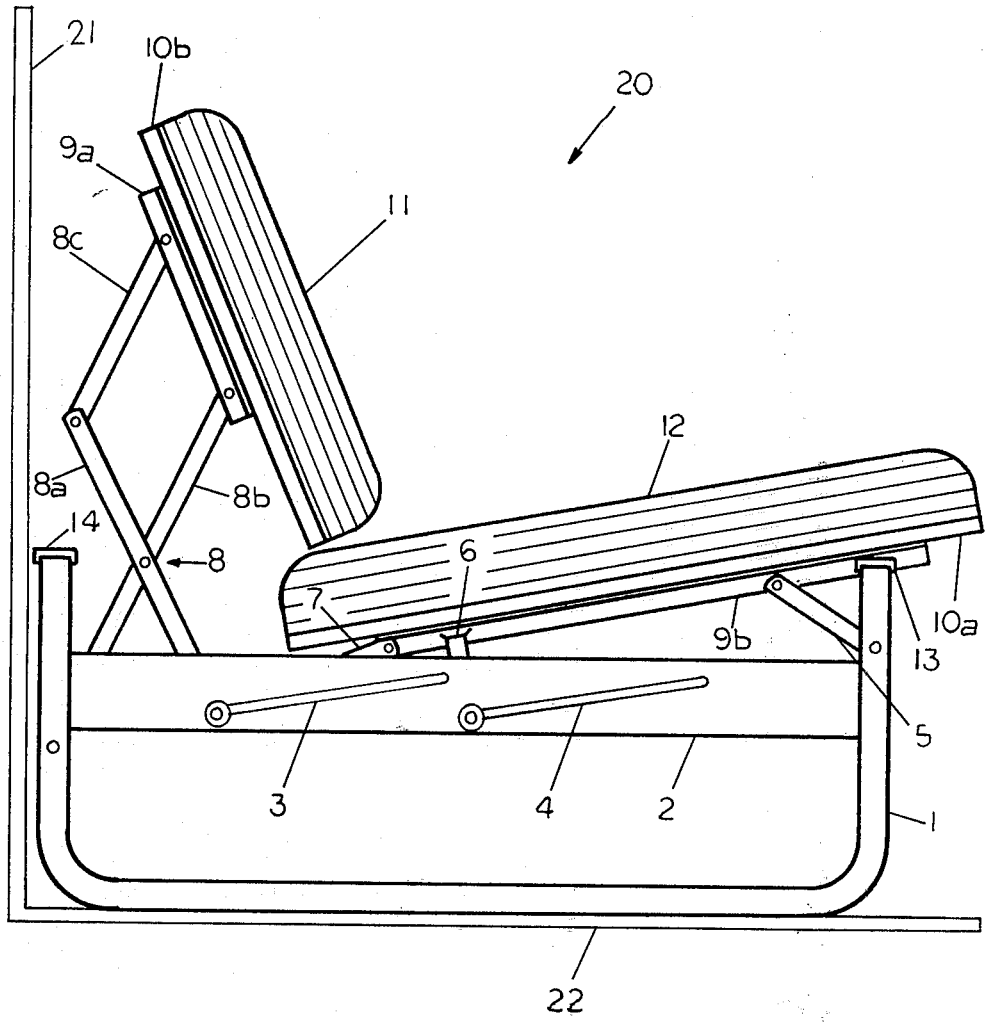
FIG. 1 is a view of the convertible seat-bed in the seat or chair position.

Reference numeral 20 designates the convertible seat-bed of this invention. Seat-bed 20 may be used anywhere desired, however, the unit has special use in campers, vans and other recreational vehicles. In the drawing, reference numeral 21 indicates a wall and 22 a floor. Note that very little clearance is required between the back cushion 11 and wall 21 for movement of the back when moving from one position to another. This is achieved by using a lazy tong like linkage 8 which makes the top back edge of the back cushion travel in a vertical path.

A support for the seat-bed is constructed of a pair of U-shaped tubular members having their closed ends resting on floor 22. The pair of U-shaped members are connected by channel members 13 and 14. The top of one leg of one of the U-shaped members is connected to the top of the opposite one leg of the other U-shaped member by channel member 13. A corresponding connection by channel member 14 is made with the tops of the second legs of the pair of U-shaped members. Each U-shaped member has the upper portions of its legs connected by a flat member 2.

Figure 2:
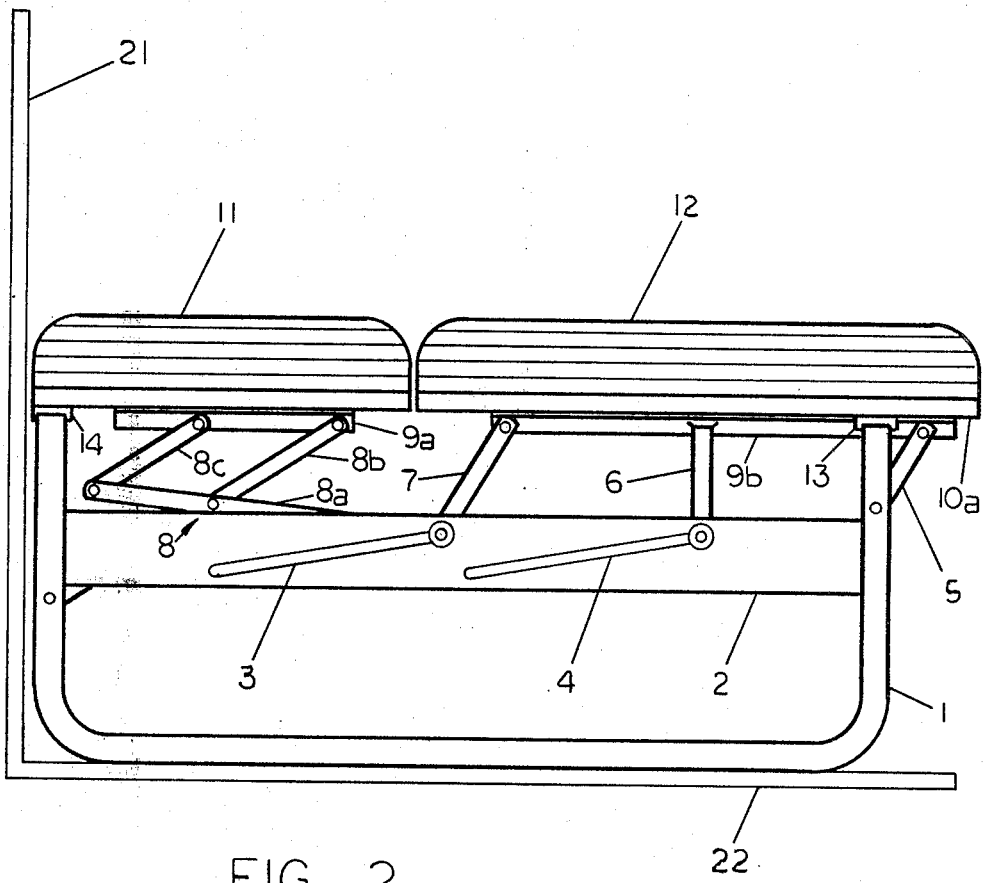
FIG. 2 is a view of the convertible seat-bed in the bed position.
Figure 3:
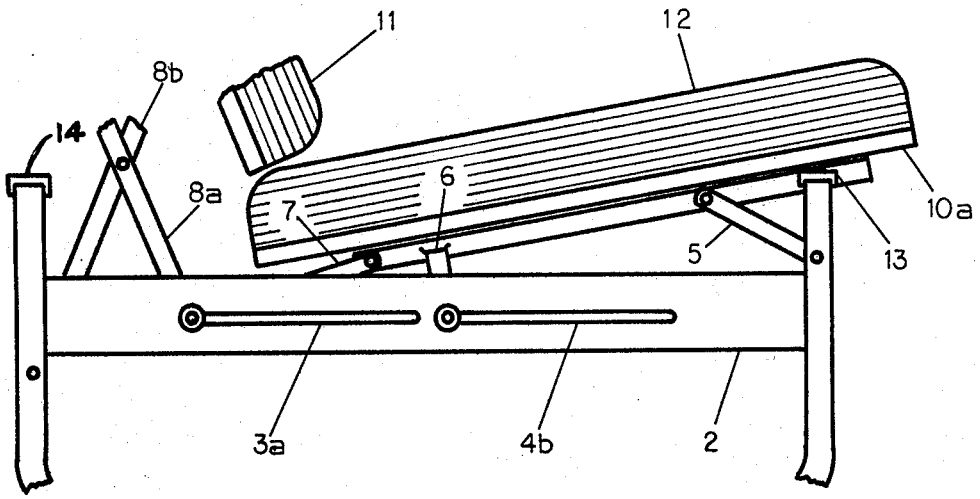
FIG. 3 is a partial view of the seat-bed illustrating an alternative construction of the guides in the supporting base.

The rigidifying member 2 includes guides 3 and 4 having straight or curved grooves which may slope up towards the front of the seat-bed as illustrated in FIGS. 1 and 2. If desired the guides may be made level in member 2 as illustrated in FIG. 3. The sloping guides appear to give better seat movement and are preferred.

A first embodiment of the seat connecting linkage illustrated in FIGS. 1 and 2 show three links 5, 6 and 7 for supporting the seat support **9*b* which in turn supports a seat cushion 12. Link 5 pivotally connects the front of the seat support 9*b* to the front leg of the U-shaped frame or base. Link 6 pivotally connects the seat support to guide 4. Link 7 pivotally connects seat support to guide 3 and also to a link 8*a***.

Figure 4:
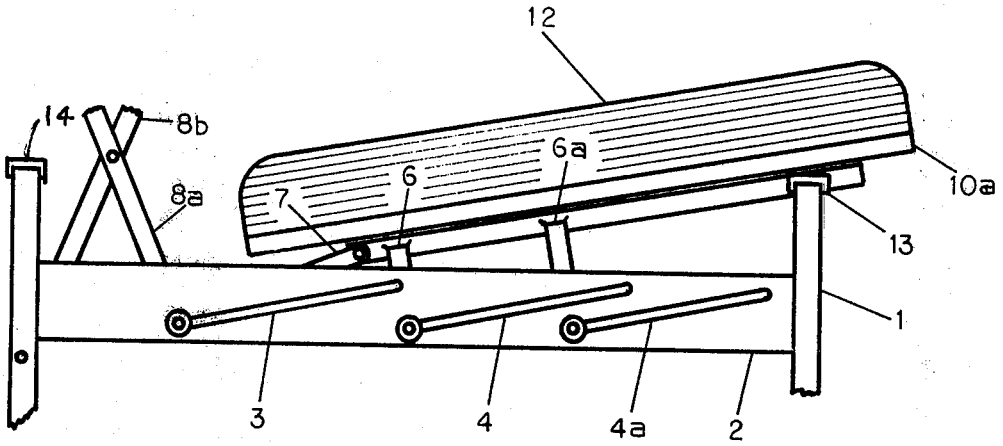
FIG. 4 is a partial view of the seat-bed illustrating a link and guide means used in lieu of the seat supporting locking link shown in FIGS. 1 and 2.

A second embodiment of the seat support links is illustrated in FIG. 4. Here a third link **6*a* and guide 4*a* are used in lieu of the locking link 5** which is used in the first embodiment.

A lazy tong like linkage 8 (FIG. 1) controlling the movement of the back support, which is used to support back cushion 11, consists of three links **8*a*, 8*b* and 8*c* wherein links 8*a* and 8*b* are interconnected at an intermediate point. One end (top) of the link 8*b* is connected to back support 9*a* and the other end to the base 1. Link 8*a* besides being pivotally connected at its lower end to link 7, as previously mentioned, is at its other end pivotally connected to link 8*c* of whose top end is pivotally connected to back support 9*a***.

Figure 5:
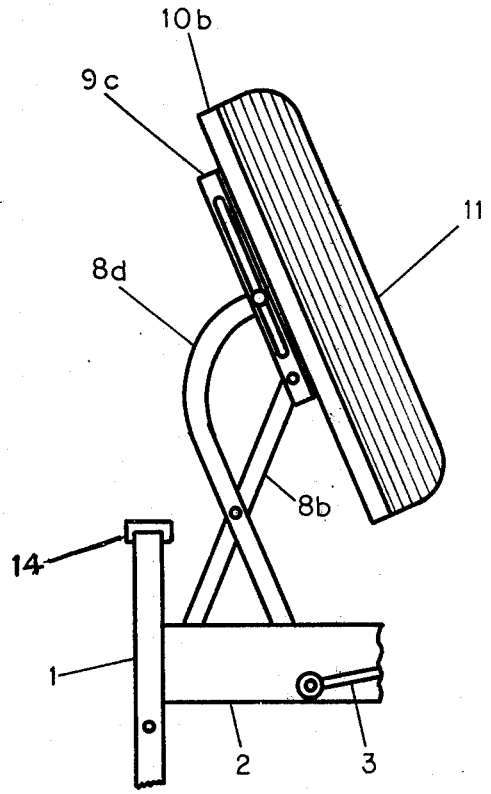
FIG. 5 is a partial view of the seat-bed illustrating an alternative construction of the lazy tong like linkage.

A second embodiment of the lazy tong like linkage illustrated in FIG. 5 shows a single link **8*d* and a grooved cushion support 9*c* used in lieu of the linkages 8*a*, 8*c* and cushion support 9*a* illustrated in FIG. 1**.

If desired a torsion spring may be added to the pivot joint connecting levers **8*a* and 8*c*. One end of the spring would bear against lever 8*a* and the other end of the spring would bear against lever 8*c*** such that when in the bed position the spring would be in a stressed condition. This feature could be used in any size seat-bed but would be of aid especially to the user of a large seat-bed assembly.

Although not shown it is contimplated that appropriate bearings would be used where needed.

With the arrangement thus far described and the seat-bed in the seat position as illustrated in FIG. 1, to convert to the bed position, the user pulls up and out on the seat. Note that the seat and back angles are such as normally found in the furniture art. Movement of the seat by the user in an up and out direction extends the seat to the bed position. During this movement linkages 6 and 7 cause the seat cushion to raise to a predetermined level with link 5 locking the seat in the bed position when the seat is extended. Lazy tong like linkage 8 operated by lever 7 causes the linkage 8 to collapse moving the top back edge of the back cushion 11 into a vertical downward path and at the same time causing the lower end of the cushion 11 to move in a following path with the seat cushion forming a bed therewith. In the bed position the seat support **9*b* will rest on channel 13 and the back support will rest on channel 14**.

I claim as my invention:

1. In a convertible seat-bed assembly, a base, a seat support for supporting a seat cushion, a back support for supporting a back cushion; linkage means for supporting said seat and back supports from said base for movement between a seating position and a bed position, said linkage means including:

a first lever means for supporting and controlling said seat support in the seat and bed positions having a link means connecting said seat to said base including a link pivoted at one end for rotary movement and a guide at the other end allowing said link linear movement relative to said base;

second link means pivoted to said back support, said base and said link and guide of said first lever means for controlling the movement of the top back edge of said back cushion attached to said back support to move in a substantially vertical straight path from an upright position to a colapsed position forming a back of a seat in the upright position and part of a bed in the colapsed position.

2. The convertible seat-bed of claim 1 wherein said first lever means includes a locking link for locking said seat support in the seat or bed positions.

3. The convertible seat-bed of claim 1 wherein said link and guide of said first lever means consists of three links and guides, 4. The convertible seat-bed of claim 1 wherein said second link means is a lazy tong like linkage means having one end connected to said back support and its opposite end connected to said base and said first lever means.

5. The convertible seat-bed of claim 1 wherein the link and guide means of said first lever means consists of at least a first and second link pivotally connecting said seat support to respective first and second guides in said base.

6. The convertible seat-bed of claim 1 wherein the guides of said link and guide means are in a level position in the base.

7. The convertible seat-bed of claim 3 wherein the guides of said first lever means are elongated slots in the base which slant up towards the front of the seat-bed.

8. The convertible seat-bed of claim 1 wherein said second link includes first and second links pivoted together at an intermediate position and a guide in said back support for allowing said first link linear movement relative to said back support, said guide being pivotally supported on one end of said first link, the opposite end of said first link being connected to said link and guide, and said second link pivotally connecting said back support and said base.

9. In a convertible seat-bed assembly, a base, a seat support for supporting a seat cushion, a back support for supporting a back cushion; linkage means for supporting said seat and back supports from said base for movement between a seating position and a bed position, said linkage means including:

a first lever means for supporting and controlling said seat support in the seat and bed positions having a link means including link and guide means pivoted at one end to said seat support and at its other end to said base;

second lever means pivoted to said back support, said base and said link and guide means for controlling the movement of the top back edge of said back cushion attached to said back support to move in a vertical path from an upright position to a colapsed position forming a back of a seat in the upright position and part of a bed in the colapsed position, said second lever includes first and second links pivoted together at an intermediate position, a connecting link having one end pivotally connected to said back support, said first link having one end connected to the other end of said connecting link and its opposite end connected to said link and guide means, and said second link pivotally connecting said back support and said base.

* * * * *